US009510668B2

(12) United States Patent
Patel et al.

(10) Patent No.: US 9,510,668 B2
(45) Date of Patent: Dec. 6, 2016

(54) ORAL CARE IMPLEMENT HAVING VISUAL INDICATOR OF DEPLETION OF A FLUID

(75) Inventors: Madhusudan Patel, Somerset, NJ (US); Suman Chopra, Monroe, NJ (US); Thomas J. Boyd, Metuchen, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 488 days.

(21) Appl. No.: 14/112,761

(22) PCT Filed: Apr. 29, 2011

(86) PCT No.: PCT/US2011/034583

§ 371 (c)(1), (2), (4) Date: Oct. 18, 2013

(87) PCT Pub. No.: WO2012/148423

PCT Pub. Date: Nov. 1, 2012

(65) Prior Publication Data

US 2014/0026811 A1 Jan. 30, 2014

(51) Int. Cl.

| | |
|---|---|
| ***A46B 11/00*** | (2006.01) |
| ***G04F 1/00*** | (2006.01) |
| ***G01K 3/00*** | (2006.01) |
| ***A61C 19/06*** | (2006.01) |

(52) U.S. Cl.

CPC ..... *A46B 11/001* (2013.01); *A46B 11/0082* (2013.01); *A46B 11/0096* (2013.01)

(58) Field of Classification Search

CPC ..... A46B 11/001; A46B 11/0082
USPC ..... 401/99, 196–198, 269, 284, 188 R, 199,401/109

See application file for complete search history.

(56) References Cited

U.S. PATENT DOCUMENTS

| | | | |
|---|---|---|---|
| 3,749,503 | A | 7/1973 | Duerr |
| 3,810,479 | A | 5/1974 | Miles |
| 3,938,897 | A | 2/1976 | Craig |
| 3,954,011 | A | 5/1976 | Manske |
| 4,088,412 | A | 5/1978 | Del Bon |
| 4,695,177 | A | 9/1987 | Kuo |
| 4,950,095 | A | 8/1990 | Picard |

(Continued)

FOREIGN PATENT DOCUMENTS

| | | |
|---|---|---|
| CN | 201743182 | 2/2011 |
| DE | 202 15 859 | 2/2004 |

(Continued)

OTHER PUBLICATIONS

International Search Report and the Written Opinion of the International Searching Authority issued in International Application PCT/US2011/034583 mailed May 8, 2012.

*Primary Examiner* — Mark A Laurenzi
*Assistant Examiner* — Thomas M Abebe

(57) ABSTRACT

An oral care implement having a visual indicator of depletion. In one aspect, the oral care implement comprises a body having a reservoir containing a composition including an oral care fluid and an indicator fluid, the oral care fluid being a different color than the indicator fluid and immiscible with respect to the indicator fluid; a delivery member formed of a capillary material; and the oral care fluid and the indicator fluid arranged within the reservoir so that upon the oral care fluid within the reservoir being substantially depleted, the indicator fluid is delivered to a visible portion of the delivery member by capillary action.

27 Claims, 9 Drawing Sheets

(56) References Cited

U.S. PATENT DOCUMENTS

| | | | | |
|---|---|---|---|---|
| 5,033,898 | A | 7/1991 | Williams | |
| 5,062,728 | A | 11/1991 | Kuo | |
| 5,346,324 | A | 9/1994 | Kuo | |
| 5,800,741 | A | 9/1998 | Glenn et al. | |
| 5,913,632 | A | 6/1999 | Persad | |
| 6,068,422 | A * | 5/2000 | Smith | B43K 5/12 401/141 |
| 6,155,411 | A | 12/2000 | Ho | |
| 6,315,556 | B1 | 11/2001 | Stewart | |
| 7,237,974 | B2 | 7/2007 | Pfenniger et al. | |
| 7,338,664 | B2 | 3/2008 | Tseng et al. | |
| 7,593,290 | B2 * | 9/2009 | Stange | A46B 15/0002 116/206 |
| 9,033,602 | B2 * | 5/2015 | Boyd | A46B 11/0055 401/109 |
| 2004/0013048 | A1 * | 1/2004 | Adamy | G04F 13/06 368/327 |
| 2005/0233279 | A1 | 10/2005 | Zeh et al. | |
| 2005/0238412 | A1 | 10/2005 | Jacobs et al. | |
| 2007/0189838 | A1 * | 8/2007 | Bolton | B43K 8/04 401/203 |
| 2008/0014010 | A1 * | 1/2008 | Bartschi | A46B 11/0003 401/146 |
| 2008/0176183 | A1 * | 7/2008 | Gatzemeyer | A46B 11/001 433/82 |
| 2008/0201884 | A1 * | 8/2008 | Vazquez | A46B 9/04 15/167.1 |
| 2010/0239458 | A1 | 9/2010 | Mink et al. | |
| 2011/0041275 | A1 * | 2/2011 | Gatzemeyer | A46B 11/0093 15/210.1 |
| 2013/0101652 | A1 * | 4/2013 | Boyd | A61K 8/02 424/401 |
| 2013/0340185 | A1 * | 12/2013 | Patel | A61C 19/063 15/104.93 |

FOREIGN PATENT DOCUMENTS

| | | | | |
|---|---|---|---|---|
| EP | 0 381 818 | | 8/1990 | |
| EP | 0381818 | A1 * | 8/1990 | B43K 5/12 |
| GB | 2 388 529 | | 11/2003 | |
| WO | WO91/04520 | | 4/1991 | |
| WO | WO92/07487 | | 5/1992 | |
| WO | WO 9207487 | A1 * | 5/1992 | A46B 11/00 |
| WO | WO2007/008908 | | 1/2007 | |

* cited by examiner

ORAL CARE IMPLEMENT HAVING VISUAL INDICATOR OF DEPLETION OF A FLUID

CROSS-REFERENCE TO RELATED PATENT APPLICATIONS

The present application is a U.S. national stage application under 35 U.S.C. 371 of PCT Application No. PCT/US2011/034583, filed Apr. 29, 2011, the entirety of which is incorporated herein by reference.

FIELD OF THE INVENTION

The present invention relates generally to dispensers, and more specifically to oral care implements having a fluid delivery system and a visual indicator of depletion of the fluid.

BACKGROUND OF THE INVENTION

Toothbrushes are typically used by applying toothpaste to a bristle section followed by brushing regions of the oral cavity, e.g., the teeth, tongue and/or gums. Some toothbrushes have been equipped with fluid reservoirs and systems for delivering auxiliary oral care fluids, such as whitening agents, breathe freshening agents and others to a user's oral cavity, in addition to dentifrice. In known toothbrushes having fluid delivery capabilities, the oral care fluid is delivered to a user's oral cavity via an applicator. However, in such toothbrushes a user is unable to determine when the oral care fluid within the applicator has been depleted. Thus, a need exists for a visual indication to inform the toothbrush user that the oral care fluid within the reservoir has been depleted.

BRIEF SUMMARY OF THE INVENTION

Exemplary embodiments of the invention are directed to oral care implements that have a fluid delivery system. The inventive oral care implement comprises a body having a reservoir containing an oral care fluid and an indicator fluid therein, the oral care fluid and the indicator fluid are delivered to an applicator via capillary action. In the inventive oral care implement, the oral care fluid is a different color than the indicator fluid. When the oral care fluid is close to depletion, the indicator fluid becomes visible to a consumer.

In one embodiment, the invention can be an oral care implement comprising: a body comprising a reservoir containing a composition including an oral care fluid and an indicator fluid, the oral care fluid being a different color than the indicator fluid and immiscible with respect to the indicator fluid; a delivery member formed of a capillary material; and the oral care fluid and the indicator fluid arranged within the reservoir so that upon the oral care fluid within the reservoir being substantially depleted, the indicator fluid is delivered to a visible portion of the delivery member by capillary action.

In another embodiment, the invention can be an oral care implement comprising: a body comprising a reservoir containing a composition including an oral care fluid, the oral care fluid being a first color; a delivery member formed of a capillary material having a second color; and a visible portion of the delivery member appearing the first color when fully adsorbed with the oral care fluid and a third color upon depletion of the oral care fluid within the reservoir, wherein the first, second and third colors are different from one another.

In yet another embodiment, the invention can be a dispenser comprising: a reservoir containing a composition including a first fluid and a second fluid, the first fluid being a different color than the second fluid and immiscible with respect to the first fluid; a delivery member formed of a capillary material; and the first and second fluids arranged within the reservoir so that upon the first fluid within the reservoir being substantially depleted, the second fluid is delivered to a visible portion of the delivery member by capillary action.

In a further embodiment, the invention can be a dispenser comprising: a reservoir containing a composition including a first fluid, the first fluid being a first color; a delivery member formed of a capillary material having a second color; and a visible portion of the delivery member appearing the first color when fully adsorbed with the first fluid and a third color upon depletion of the first fluid within the reservoir, wherein the first, second and third colors are different from one another.

In a still further embodiment, the invention can be a method of providing a visual indication of depletion of an oral care fluid contained within a reservoir of an oral care implement having a delivery member formed of a capillary material, the method comprising: a) providing an indicator fluid in the reservoir with the oral care fluid, the oral care fluid being a different color than the indicator fluid and immiscible with respect to the indicator fluid; and b) upon depletion of the oral care fluid from the reservoir, delivering the indicator fluid to a visible portion of the deliver member.

In another embodiment, the invention can be a method of providing a visual indication of depletion of an oral care fluid of a first color contained within a reservoir of an oral care implement having a delivery member formed of a capillary material of a second color, the method comprising: a) changing the appearance of the visible portion of the delivery member from the second color to the first color by adsorbing the oral care fluid into a visible portion of the delivery member; and b) upon depletion of the oral care fluid from the reservoir, changing the appearance of the visible portion of the delivery member from the first color to a third color, wherein the first, second and third colors are different from one another.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
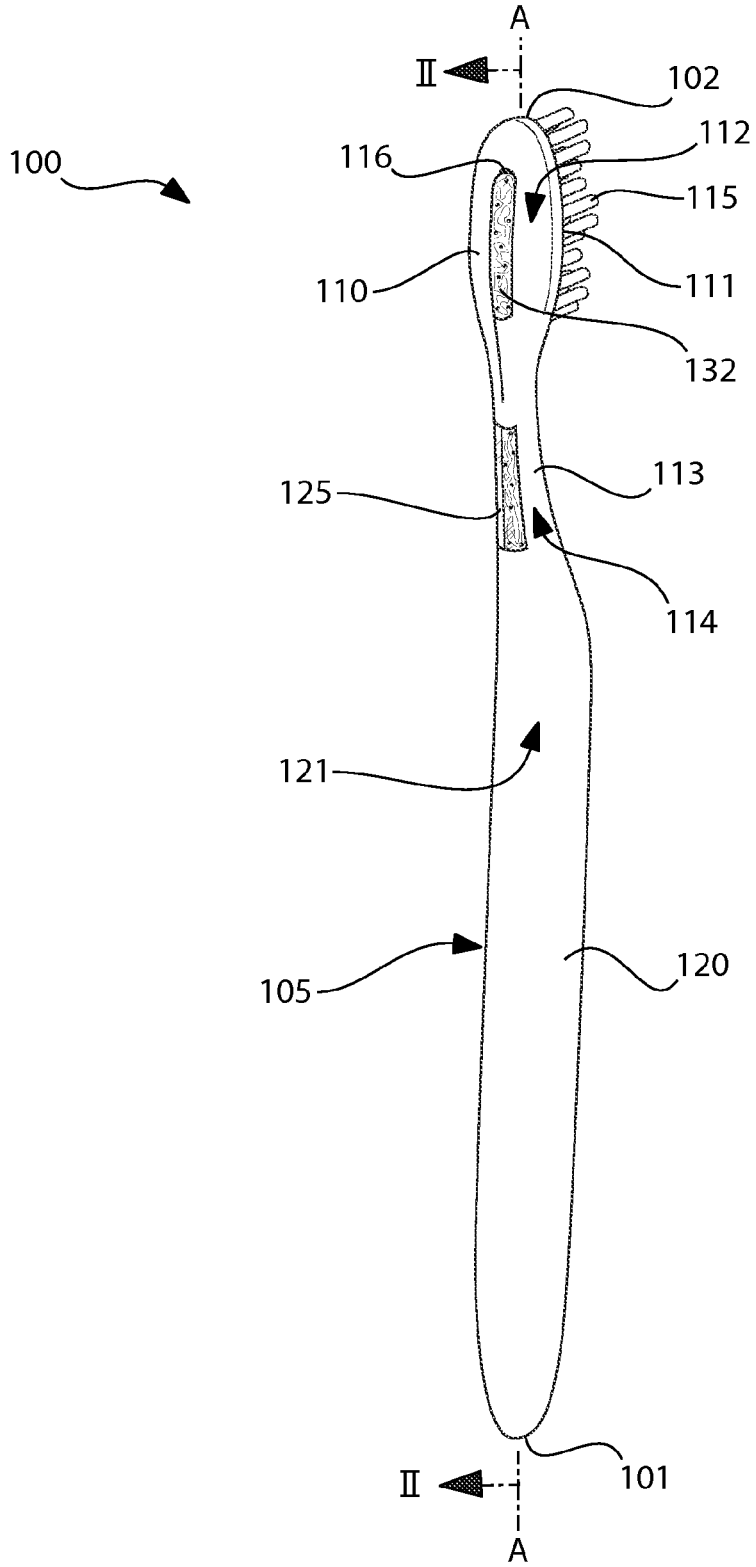
FIG. 1 is a rear perspective view of a toothbrush according to a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Referring to FIG. 1, an oral care implement 100 in accordance with one embodiment of the present invention is illustrated. In the exemplified embodiments disclosed herein, the invention is illustrated and described in the form of a manual toothbrush. However, the invention is not so limited in all embodiments, and the oral care fluid delivery system and the visual indicator of depletion techniques described herein can be incorporated into other oral care implements as desired, including without limitation a powered toothbrush, an interdental device, a soft tissue cleanser or any other type of oral care implement as is known in the art. Furthermore, in certain other embodiments the invention may simply be a dispenser comprising the structure and techniques for depletion indication described herein.

The oral care implement 100 extends from a proximal end 101 to a distal end 102 along a longitudinal axis A-A. The oral care implement 100 generally comprises a body 105 having a head 110 and a handle 120. The body 105 is constructed of a material having suitable rigidity for handling of the oral care implement 100 and being sufficiently impervious to fluids so that oral care fluid can be stored within an internal reservoir (discussed below). Suitable material include hard plastics, such as polyethylene, polypropylene (PP), polyamide, polyester, cellulosics, SAN, acrylic, ABS or any other of the commonly known thermoplastics used in toothbrush manufacture.

The head 110 is coupled to a distal end of the handle 120. In the exemplary embodiment, the head 110 and the handle 120 are integrally formed as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 110 and the handle 120 are of a unitary or multi-piece construction (including connection techniques) is not limiting of the present invention, unless specifically claimed. In some embodiments of the invention, the head 110 may be detachable (and replaceable) from the handle 120 using techniques known in the art.

The head 110 comprises a front surface 111 and a rear surface 112. The front surface 111 and the rear surface 112 of the head 110 can take on a wide variety of shapes and contours, none of which are limiting of the present invention. For example, the front and rear surfaces 111, 112 can be planar, contoured or combinations thereof. Moreover, if desired, the rear surface 112 of the head 110 may also comprise additional structures (in addition to an applicator 132, described in detail below) for oral cleaning, such as an elastomeric soft tissue cleanser. An example of a suitable elastomeric soft tissue cleanser is disclosed in U.S. Pat. No. 7,143,462, issued Dec. 5, 2006 to the assignee of the present application, the entirety of which is hereby incorporated by reference. Furthermore, while the head 110 is normally widened relative to a neck 113 of the handle 120, it could in some constructions simply be a continuous extension or narrowing of the handle 120.

The head 110 also comprises a plurality of tooth cleaning elements 115 extending from the front surface 111. The tooth cleaning elements 115 are generically illustrated as a plurality of tufts of bristles. However, the invention is in no way limited by the configuration or material of the tooth cleaning elements 115. Furthermore, while the plurality of tooth cleaning elements 115 are particularly suited for brushing and/or polishing teeth, the plurality of tooth cleaning elements 115 can also be used to clean oral soft tissue, such as a tongue, gums, or cheeks instead of or in addition to teeth.

As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The plurality of tooth cleaning elements 115 can be mounted to the head 110 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable depressions in the tuft blocks so that the base of the bristles is mounted within or below the tuft block.

The body 105 of the oral care implement 100 comprises an outer surface 121 with a window 125 formed therein. In the exemplified embodiment, the window 125 is formed into a rear surface 114 of the neck portion 113 of the body 105. However, in certain other embodiments, the window 125 can be positioned at other locations on the body 105 including on a front surface of the neck portion 113, the rear surface 112 of the head 110, on the handle 110 or at any other location on the outer surface 121 of the body 105. In still other embodiments, the window 125 may be altogether omitted. The window 125 is a portion of the body 105 that is sufficiently transparent so as to enable a user to see through the outer surface 121 of the body 105 and into an internal region of the oral care implement 100 as will be described below. Of course, the invention is not limited to the window 125 being a completely transparent portion of the outer surface 121 of the body 105. As used herein, the term transparent is intended to include translucent materials or other materials that are capable of being seen through.

In the exemplified embodiment, the window 125 is a portion of the outer surface 121 of the body 105 that is transparent and elongated along the longitudinal axis A-A of the oral care implement 100. However, the invention is not to be so limited and in certain other embodiments the window 125 can take on any shape as long as the window 125 is large enough to enable a user to see through the outer surface 121 of the body 105 and into the internal region of the oral care implement 100. More specifically, the window 125 should enable a user to be able to see the color of a portion of a delivery member 130 that is disposed within the internal region of the oral care implement 100 and aligned with the window 125 as will be described below.

Figure 2:
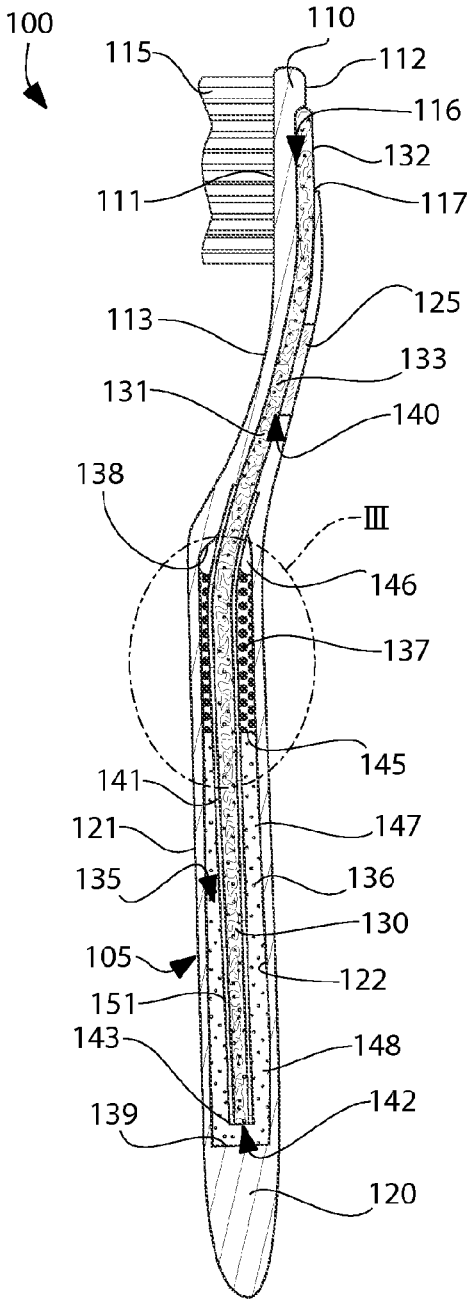
FIG. 2 is a longitudinal cross-sectional view of the toothbrush of FIG. 1 taken along line II-II of FIG. 1, the reservoir contains a full amount of an oral care fluid and an indicator fluid.

Referring now to FIGS. 1 and 2 concurrently, the oral care implement 100 will be described in more detail. The body 105 of the oral care implement 100 generally comprises an outer surface 121 and an inner surface 122. The inner surface 122 of the body 105 defines an internal reservoir 135 containing a fluid composition therein. More specifically, the reservoir 135 is defined by the space between a floor 139 of the reservoir 135, a ceiling 138 of the reservoir 135 and the inner surface 122 of the body 105. Thus, the body 105 forms a housing, which contains the reservoir 135 and the fluid composition. In the exemplified embodiment, the reservoir 135 is located within the handle 120. However, in alternate embodiments the reservoir 135 may be located within the head 110, the neck 113, the handle 120, and/or combinations thereof. The reservoir 135 can be conceptually divided into a top portion 146, a middle portion 147 and a bottom portion 148. In addition, while the reservoir 135 is illustrated as a single reservoir, in certain embodiments, the reservoir 135 may consist of multiple reservoirs.

The fluid composition includes an oral care fluid 136 and an indicator fluid 137. The oral care fluid 136 is a different color than the color of the indicator fluid 137, and it is preferred that the colors of the two fluids 136, 137 are sufficiently distinct. Thus, in certain embodiments, the oral care fluid 136 can be a blue fluid and the indicator fluid 137 can be a red fluid. Of course, other visible colors can be utilized as desired. In certain other embodiments, one of the oral care fluid 136 or the indicator fluid 137 will be transparent while the other one of the oral care fluid 136 or the indicator fluid 137 will be a visible color (such as red, blue, green, yellow, purple, orange, etc.). Thus, as used herein, transparent, white and black are considered "colors" for certain embodiments of the present the invention. Moreover, in certain embodiments, different shades or intensities of the same visible color may be considered "different colors." Further, in certain embodiments, both fluids 136, 137 may be transparent fluids with different colored suspensions. For example, oral care fluid 136 may contain a transparent fluid with red beads suspended therein, and the indicator fluid 137 may contain a transparent fluid with blue beads suspended therein.

While the invention is not to be limited by the particular colors of the oral care fluid 136 and the indicator fluid 137, it may be preferable that the indicator fluid 137 be an intense color so that it is easily seen through the window 125 (described in more detail below). In all embodiments illustrated in this application, different colors are illustrated as different stippling patterns. For example, in the exemplified embodiment of FIGS. 1-5, the smaller-sized stipples of the oral care fluid 136 represent a first color while the larger-sized stipples of the indicator fluid 137 represent a second color that is different than the first color.

The oral care fluid 136 and the indicator fluid 137 are immiscible with respect to one another, and thus are incapable of mixing together to form a homogenous solution. As such, the oral care fluid 136 remains separate from the indicator fluid 137 within the reservoir 135, even when in contact with one another. In the embodiment exemplified in FIGS. 2 and 3, the indicator fluid 137 floats atop of the oral care fluid 136 to form a fluid-to-fluid interface 145. In certain other embodiments as will be described below in FIGS. 6-8, the relative arrangement of the indicator fluid 137 and the oral care fluid 136 can be switched so that the oral care fluid 136 floats atop the indicator fluid 137. In certain embodiments, the oral care fluid 136 preferably takes up between 75-99% of the volume of the reservoir 135, and more preferably between 90-99% of the volume of the reservoir 135, and most preferably 95% of the volume of the reservoir 135. The indicator fluid 137 can occupy the remaining volume of the reservoir 135. In such embodiments, the indicator fluid 137 preferably takes up between 1-25% of the volume of the reservoir 135, and more preferably between 1-10% of the volume of the reservoir 135 and most preferably 5% of the volume of the reservoir 135. Of course, the invention is in no way limited to the aforementioned ratios unless specifically recited in the claims.

Figure 3:
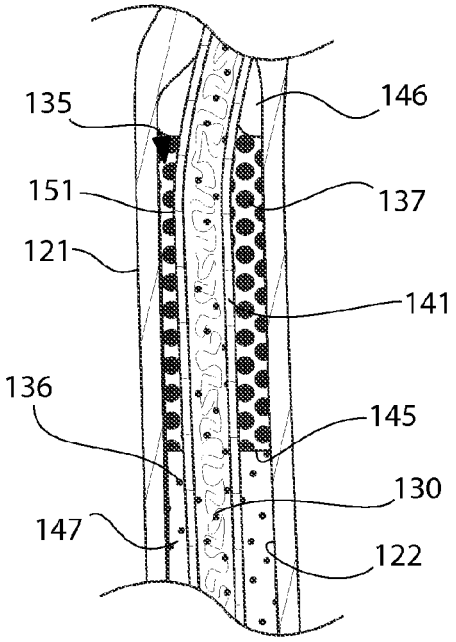
FIG. 3 is a close-up view of section III of FIG. 2.

Referring specifically to FIGS. 2 and 3 concurrently, in order to enable the indicator fluid 137 to float atop of the oral care fluid 136, the indicator fluid 137 can be formed of a fluid that is less dense than the fluid of the oral care fluid 136. In one such embodiment, the indicator fluid 137 can be a colored oil-based fluid, such as mineral oil or ethyl acetate that is colored with riboflavin, and the oral care fluid 136 can be a hydrophilic or water-based fluid. In still other embodiments, the oral care fluid 136 is a hydrophilic fluid and the indicator fluid 137 is a hydrophobic fluid, irrespective of their relative densities. Of course, as noted above the invention is not so limited and either one of the oral care fluid 136 or the indicator fluid 137 can be the hydrophobic or hydrophilic material and either one of the oral care fluid 136 or the indicator fluid 137 can be the more dense fluid or less dense fluid. The desired relative properties and positioning of the oral care fluid 136 and the indicator fluid 137 will depend on such factors such as the particular structure of the oral care implement 100, the delivery member 130, and/or the reservoir 135.

The oral care fluid 136 is a fluid that provides a user with an oral hygiene benefit upon use, specific examples of which will be described below. The indicator fluid 137 is merely intended to indicate to a user when the oral care fluid 136 has been substantially depleted. Specifically, the indicator fluid 137 indicates to a user that the oral care fluid 136 has been depleted because the indicator fluid 137 is adsorbed by a delivery member 130 (described below) after the oral care fluid 136 has been substantially depleted. As a result, the indicator fluid 137 changes the appearance, such as the color, of a visible portion of the delivery member 130. Thus, the indicator fluid 137 does not need to provide oral hygiene benefits to a user. However, the invention is not so limited and in certain embodiments the indicator fluid 137 may provide oral hygiene benefits to a user. Furthermore, it should be understood that regardless of whether or not the indicator fluid 137 actually provides oral hygiene benefits to a user, the indicator fluid 137 should be selected so as to be non-toxic when ingested for precaution.

As noted above, the oral care fluid 136 provides oral health benefits to a user upon contact with the user's oral cavity. For example, in certain embodiments the oral care fluid 136 is a mouthwash solution that cleans the oral surfaces when applied thereto and provides the user with breath freshening benefits. In other embodiments, the oral care fluid 136 is a tooth cleaning solution. Of course, the oral care fluid 136 is not to be in any way limiting of the present invention and may include fluids or agents that deliver therapeutic, cosmetic, experiential and/or sensorial benefits to a consumer during an interdental cleaning regimen. Specifically, the oral care fluid 136 can be anti-sensitivity agents, fluoride, tartar protection agents, antibacterial agents, oxidative or whitening agents, enamel strengthening or repair agents, tooth erosion preventing agents, tooth sensitivity ingredients, gum health actives, nutritional ingredients, tartar control or anti-stain ingredients, enzymes, sensate ingredients, flavors or flavor ingredients, breath freshening ingredients, oral malodor reducing agents, anti-attachment agents or sealants, diagnostic solutions, occluding agents, dry mouth relief ingredients, catalysts to enhance the activity of any of these agents, colorants or aesthetic ingredients, arginine bicarbonate, chlorohexidine, triclosan, CPC, zinc oxide and combinations thereof. In certain embodiments, the oral care fluid 136 is free of a dentifrice as the oral care fluid 136 is intended to supplement traditional brushing of the teeth rather than supplant it.

Still referring to FIGS. 2 and 3, the body 105 of the oral care implement 100 also comprises a channel 140 that extends from the reservoir 135 to an opening 117 in the outer surface 121 of the body 105. In the exemplified embodiment, the opening 117 is located on the rear surface 112 of the head 110. However, the invention is not so limited and in certain other embodiments the opening 117 may be formed at other locations on the outer surface 121 of the body 105. For example, the opening 117 may be located on the handle 120 or the neck 113, or even on the front surface 111 of the head 110 if desired. The opening 117 forms a passageway from the channel 140 to a depression 116 on the rear surface 112 of the head 110. The depression 116 provides a basin in which the applicator 132 can nest. As such, the applicator 132 is exposed on the rear surface 112 of the head 110 and can be considered a visible portion of the delivery member 130 (described below).

The channel 140 forms a passageway from the reservoir 135 to the opening 117. In the exemplified embodiment, the channel 140 is an axial channel extending along the longitudinal axis A-A. In other embodiments, the channel 140 may extend substantially transversely or at an oblique angle to the longitudinal axis A-A. The channel 140 may be linear, curved, and/or combinations thereof. The exact shape and orientation of the channel 140 will be dictated by considerations such as the position of the opening 117 on the body 105, the position of the reservoir 135 within the body 105, and the shape of the body 105.

The delivery member 130 is an elongated rod formed of a capillary material that is disposed within the reservoir 135 and extends from the reservoir 135, through the channel 140 and the opening 117 and into the depression 116. The delivery member 130 can be conceptually divided into a conduit portion 131 that is disposed within the channel 140 and the applicator 132 that nests within the depression 116. Thus, in the exemplified embodiment, the delivery member 130 has two visible portions, one of which is the applicator 132 (which is visible by virtue of being exposed) and the other of which is the visible portion 133 of the delivery member 130 (which is aligned with and visible through the window 125). It should be understood that in some embodiments the window 125 may be altogether omitted so that the only portion of the delivery member 130 that is visible to a user is the applicator 132 and/or another exposed portion.

As will be described in more detail below, a user will be able to determine when the oral care fluid 136 within the reservoir 135 has been substantially depleted based when the user sees the color of the indicator fluid 137 (or a color that is a combination of the color of the indicator fluid 137 and the color of the oral care fluid 136) on the applicator 132 or the visible portion 133 of the delivery member 130. In other words, the color change on the applicator 132 or the visible portion 133 of the delivery member 130 will indicate to the user that the oral care fluid 136 within the reservoir 135 has been substantially depleted. In the exemplified embodiment, the delivery member 130 and the applicator 132 are integral to one another and of unitary construct. However, in other embodiments the delivery member 130 and the applicator 132 can be separate and distinct components and/or structures that are fluidly and/or structurally coupled together when the oral care implement 100 is assembled.

The fluid delivery member 130, including the conduit portion 131 and the applicator 132, is formed of a capillary material so that the oral care fluid 136 and the indicator fluid 137 are delivered from the reservoir 135 to the applicator 132 via capillary action. In one embodiment, the delivery of the oral care fluid 136 and the indicator fluid 137 from the reservoir 135 to the applicator 132 is effectuated solely by capillary action or wicking Thus, the fluid delivery member 130 is formed of a capillary material that can absorb and/or transport a fluidic material via capillary action. More specifically, a capillary material is a material, such as a sponge, that absorbs and holds fluid, and that upon sufficient contact or pressure releases the fluid. Examples of suitable capillary materials include, without limitation, a porous material, a fibrous material or a material comprising one or more capillary channels. Of course, in other embodiments, the delivery of the oral care fluid 136 and/or the indicator fluid 137 from the reservoir 135 to the applicator 132 can be accomplished via a combination of capillary action and mechanical action, such as a pump, an actuatable piston, a pressurizer, or a compressible bladder.

Still referring to FIGS. 2 and 3, the oral care implement 100 comprises a sheath 141. The sheath 141 extends from the channel 140 and into the reservoir 135 and terminates near, but prior to the floor 139 of the reservoir 135. The sheath 141 is disposed within the reservoir 135 so that a space is formed concentrically between an outer surface 151 of the sheath 141 and the inner surface 122 of the body 105 of the oral care implement 100. The sheath 141 can be formed integrally with the oral care implement 100 or it can be a separate component of the oral care implement 100 that is later affixed or coupled to the oral care implement 100 by any means known in the art, including without limitation thermal or ultrasonic welding, a tight-fit assembly, a coupling sleeve, threaded engagement, adhesion, or fasteners. Alternatively, the sheath 141 can be applied directly to and affixed to the delivery member 130 as a coating or sleeve.

The delivery member 130 is disposed within the sheath 141 through the top and middle portions 146, 147 of the reservoir 135. The sheath 141 is formed of a fluid impermeable material so that the oral care fluid 136 and the indicator fluid 137 within the reservoir 135 cannot penetrate through the sheath 141 and be adsorbed by the delivery member 130. Examples of the material that can be used to form the sheath 141 include hard plastics, such as polyethylene, polypropylene (PP), polyamide, polyester, SAN, acrylic, ABS or any other of the commonly known thermoplastics or films used in the industry. The sheath 141 has an opening 142 at a bottom end 143 thereof that provides fluid communication between the delivery member 130 and the composition within the reservoir 135, and specifically at the bottom portion 148 of the reservoir 135. Thus, a fluid that is disposed within the bottom portion 148 of the reservoir 135 will be adsorbed into the capillary material of the delivery member 130 via the opening 142. Stated simply, the delivery member 130 is in fluid communication with the composition (the oral care fluid 136 and/or the indicator fluid 137) only at the bottom portion 148 of the reservoir 135. As used herein, the term adsorb should be understood to include both absorption and adsorption.

As discussed above, in FIG. 2 the indicator fluid 137 floats atop of the oral care fluid 136 so as to form a fluid-to-fluid interface 145 between the indicator fluid 137 and the oral care fluid 136. As such, the oral care fluid 136 is positioned within the bottom portion 148 of the reservoir 135 so that the oral care fluid 136 can flow through the opening 142 in the sheath 141 and be adsorbed by the delivery member 130. The delivery member 130 will not adsorb or soak up the indicator fluid 137 because the indicator fluid 137, which is floating atop of the oral care fluid 136, can not penetrate the sheath 141 or enter into the sheath 141 through the opening 142. This is the case so long as the fluid-to-fluid interface 145 remains above the opening 142. Thus, as is illustrated in FIG. 2, the capillary material of the delivery member 130 is saturated by the oral care fluid 136. As such, the capillary material of the delivery member 130 will visually appear as the color of the oral care fluid 136. Thus, if the oral care fluid 136 is a clear fluid, the delivery member 130 will appear as its natural color and if the oral care fluid 136 is a blue fluid, the delivery member 130 will appear blue (or at least a shade thereof or a resultant color of the delivery member 130 and the oral care fluid 136). A user is able to see the color of the delivery member 130 at any given time by viewing the visible portion 133 of the delivery member 130 through the window 125 (or by directly viewing the applicator 132).

As the oral care implement 100 is used, the pressure of a user's oral surfaces against the applicator 132 causes the applicator 132 (and hence the delivery member 130, which is formed unitarily with the applicator 132) to release the oral care fluid 136 that has been adsorbed by the delivery member 130. As the delivery member 130 continues to release the oral care fluid 136, it also adsorbs additional oral care fluid 136 from the bottom portion 148 of the reservoir 135 by capillary action to replace the released oral care fluid 136. Thus, as the oral care implement 100 is used, the fluid-to-fluid interface 145, and hence also the indicator fluid 137, moves toward the bottom portion 148 of the reservoir 135 (and also toward the opening 142 at the bottom end 143 of the sheath 141). Thus, it should be understood that a substantial amount of the indicator fluid 137 is not delivered to the visible portion 133 of the delivery member 130 until the oral care fluid 136 within the reservoir 135 is substantially depleted.

Figure 4:
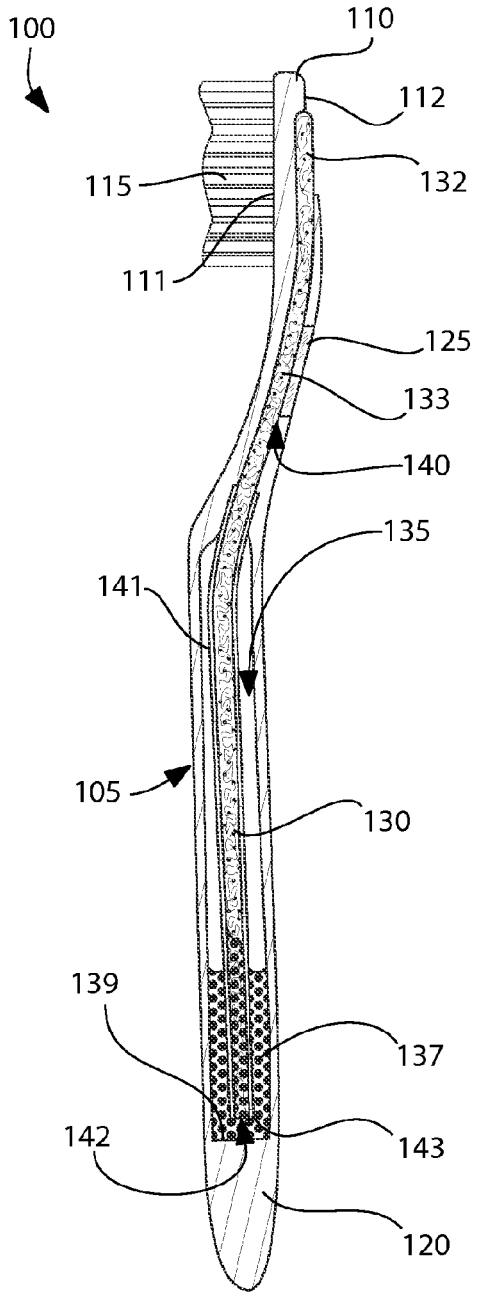
FIG. 4 is a similar view as FIG. 2, wherein the oral care fluid has been depleted from the reservoir and the indicator fluid is adsorbed into a bottom portion of a delivery member.
Figure 5:
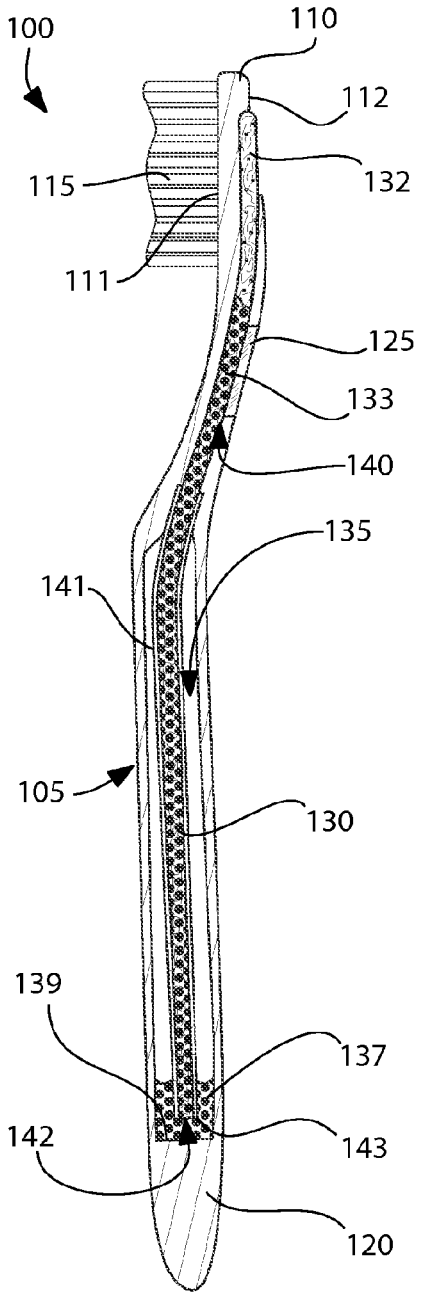
FIG. 5 is a similar view as FIG. 2, wherein the indicator fluid has been delivered to a visible portion of the delivery member by capillary action.

Referring now to FIGS. 4 and 5 concurrently, the visible cue that indicates depletion of the oral care fluid 136 will be described in more detail. Once the fluid-to-fluid interface 145 is located below the opening 142 the opening 142, the oral care fluid 136 can be considered to be depleted from the reservoir 135. However, the delivery member 130 is still saturated with the oral care fluid 136, thus enabling a user to continue using the oral care implement 100 to receive the benefits of the oral care fluid 136. As the oral care implement 100 continues to be used as described above, the delivery member 130 begins to adsorb the indicator fluid 137 via the opening 142 in the bottom end 143 of the sheath 141. In other words, after the oral care fluid 136 is depleted from the reservoir 135, the indicator fluid 137 no longer floats atop of the oral care fluid 136 and is instead able to enter into the sheath 141 via the opening 142.

The user will continue to use the oral care implement 100 until the delivery member 130 has adsorbed a sufficient amount of the indicator fluid 137 so that the indicator fluid 137 is delivered to either the visible portion 133 of the delivery member 130 or to the applicator 132, which is also visible due to being exposed. Thus, after prolonged use of the oral care implement 100, the concentration of the indicator fluid 137 within the delivery member 130 will be higher than the concentration of the oral care fluid 136 within the delivery member 130, thereby changing the visible color of the visible portion 133 (and/or the applicator 132). In certain embodiments, the oral care implement 100 is capable of being used multiple times before the indicator fluid 137 changes the color of the visible portion 133 (and/or the applicator 132) of the delivery member 130. Of course, in certain other embodiments the oral care implement 100 may be a single use toothbrush such that the indicator fluid 137 becomes visible on the visible portion 133 of the delivery member 130 during the first use of the oral care implement to indicate that the user has used the oral care implement 100 to clean the user's oral surfaces for a sufficient amount of time.

As has been discussed above, the indicator fluid 137 is a different color than the color of the oral care fluid 136. As such, when the capillary material of the delivery member 130 adsorbs or soaks up the indicator fluid 137, the color of the delivery member 130 changes from the color of the oral care fluid 136, such as blue, to the color of the indicator fluid 137, such as red. As soon as the user sees that the visible portion 133 of the delivery member 130, which is visible through the window 125, has turned to a red color (i.e., the color of the indicator fluid 137), the user will know that the oral care fluid 136 has been substantially depleted. As such, the user will know to dispose of and replace the oral care implement 100 at that time.

It should be understood that when the oral care fluid 136 is blue and the indicator fluid 137 is red, the capillary material of the visible portion 133 of the delivery member 130 (or the applicator 132) may not change directly from blue to red when the indicator fluid 137 is delivered to the visible portion 133 of the delivery member 130. Rather, the fibers of the capillary material of the delivery member 130 will likely retain some of the blue (or other) color of the oral care fluid 136 because the capillary material has a holding capacity that does not release all of the fluid. As such, as the indicator fluid 137 (which is red in this example) is delivered to the visible portion 133 of the delivery member 130 (or the applicator 132), the red color of the indicator fluid 137 may mix with the blue color of the remnants of the oral care fluid 136 to form a purple color. In this example, a user will know that the oral care fluid 136 within the reservoir 135 has been substantially depleted upon seeing the purple color. In another example, the color of the oral care fluid 136 can be yellow and the color of the indicator fluid 137 can be blue. Thus, when the indicator fluid 137 is delivered to the visible portion 133 of the delivery member 130, a user may see a green color, which is a mixture between the yellow color of the oral care fluid 136 and the blue color of the indicator fluid 137.

As discussed above, the particular colors used for the oral care fluid 136 and the indicator fluid 137 are in no way limiting of the present invention. Thus, assuming that the oral care fluid 136 is a first color and the indicator fluid 137 is a second color, the user will know that the oral care fluid 136 is depleted when the visible portion 133 of the delivery member 130 (or the applicator 132) takes on either the second color (if, for example, the first color is clear or the capillary material has a holding capacity that releases all of the oral care fluid 136) or a third color that is a resultant color from the combination of the first and second colors.

Figure 6:
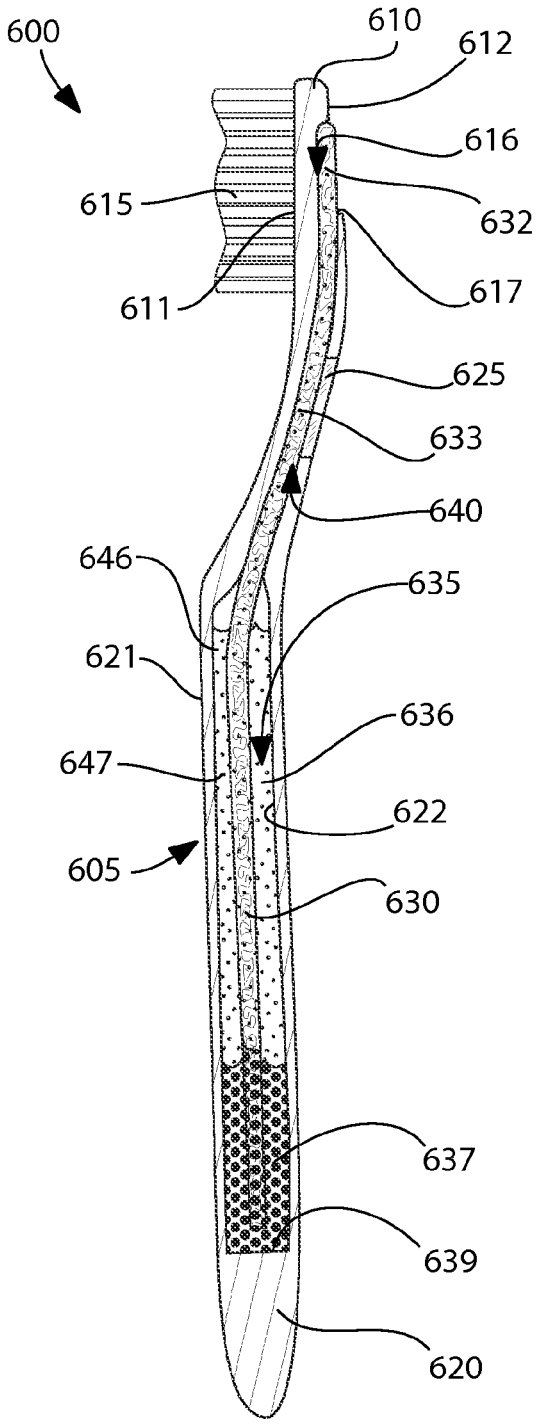
FIG. 6 is a longitudinal cross-sectional view of a toothbrush according to a second embodiment of the present invention, wherein the reservoir contains a full amount of an oral care fluid and an indicator fluid.
Figure 7:
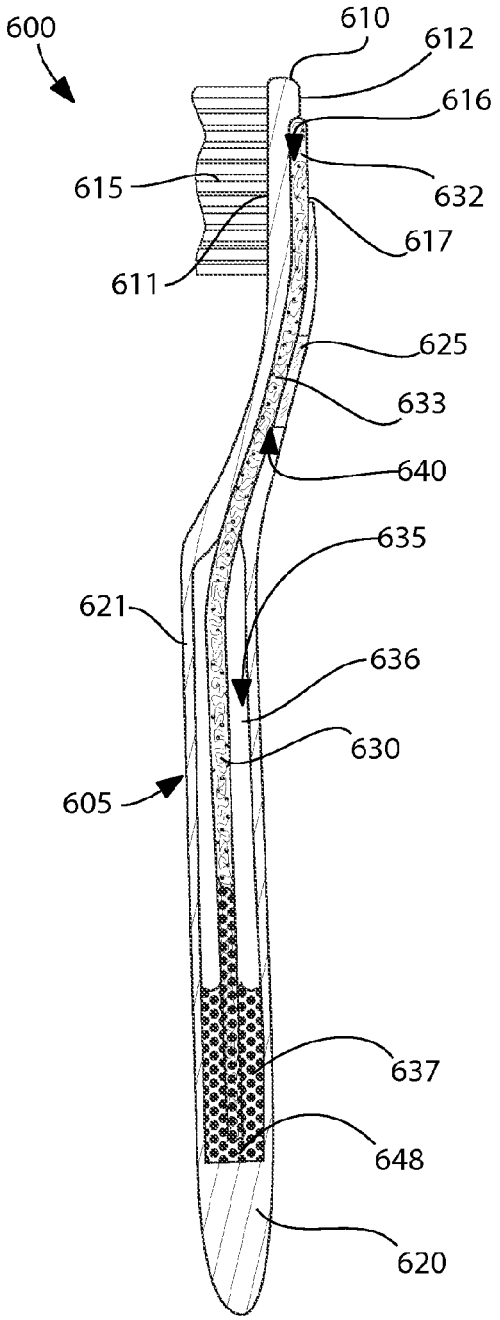
FIG. 7 is a similar view as FIG. 6, wherein the oral care fluid has been depleted from the reservoir and the indicator fluid is adsorbed into a bottom portion of a delivery member.
Figure 8:
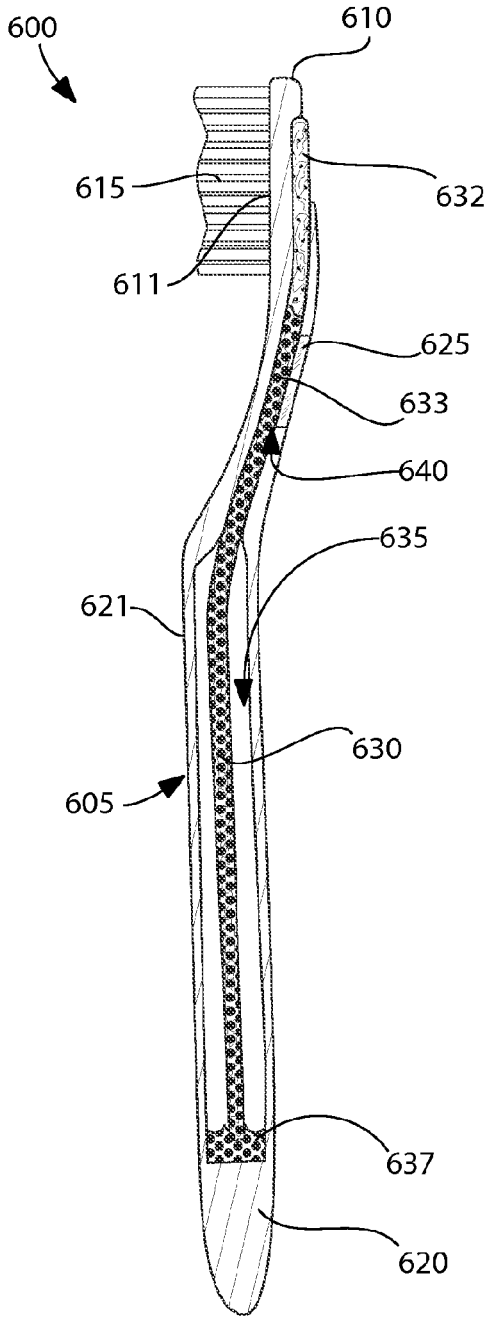
FIG. 8 is a similar view as of FIG. 6, wherein the indicator fluid has been delivered to a visible portion of the delivery member via capillary action.

Referring now to FIGS. 6-8, another embodiment of an oral care implement 600 in accordance with the present invention will be described. The oral care implement 600 has many features that are similar to or the same as features of the oral care implement 100. Thus, similar features will be similarly numbered with the exception that the 600-series of numbers will be used. It should be understood that features and components of the oral care implement 600 that are not described in detail herein are the same as corresponding features and components of the oral care implement 100. It will become apparent from the description below that the oral care implement 600 is substantially similar to the oral care implement 100 except that the oral care implement 600 does not have a sheath and an oral care fluid 636 floats atop of an indicator fluid 637.

The oral care implement 600 comprises a body 605 having a handle 620 and a head 610 coupled to an end of the handle 620. The head 610 comprises a front surface 611 from which a plurality of tooth cleaning elements 615 extend and an opposed rear surface 612. Although not illustrated, the rear surface 612 of the head 610 may comprise a soft tissue cleanser, such as was described above with regard to the oral care implement 100. The body 605 comprises an outer surface 621 and an inner surface 622. The inner surface 622 of the body 605 defines an open area or internal reservoir 635 containing a fluid composition therein. In the exemplified embodiment, the reservoir 635 is formed within the handle 620 of the body 605. Of course, the invention is not so limited and the reservoir 635 may be formed in the head 610 or neck of the oral care implement 600 in other embodiments. The reservoir 635 contains the fluid composition, which includes an oral care fluid 636 and an indicator fluid 637. The oral care fluid 636 can be any one or a combination of the fluids described above that provide a benefit to a user's oral cavity upon application thereto and the indicator fluid 637 merely provides an indication to a user, such as by color, that the oral care fluid 636 has been substantially depleted.

The oral care implement 600 comprises a channel 640 that extends from the reservoir 635 to an opening 617. The channel 640 forms a passageway from the reservoir 635 to the opening 617 and the opening 617 forms a passageway from the channel 640 to a depression 616 on the rear surface 612 of the head 610. An applicator 632 nests within the depression 616 and is exposed to the external environment on the rear surface 612 of the head 610.

A delivery member 630 formed of a capillary material, which may be a porous or fibrous material as discussed above, is disposed within the reservoir 635 and extends from the reservoir 635, through the channel 640 and the opening 617 and into the depression 616. The delivery member 630 is unitarily formed with the applicator 632 as a single structural unit. Thus, the delivery member 630 and the applicator 632 are both formed of the capillary material and are in communication such that as fluid flows from the reservoir 635 into the delivery member 630, the fluid is delivered to the applicator 632 for application to a user's oral surfaces.

The delivery member 630 extends into the reservoir 635 to near the floor 639 of the reservoir 635. In certain embodiments, the delivery member 630 may extend to and be in contact with the floor 639 of the reservoir 635. The delivery member 630 includes a visible portion 633, which is a portion of the delivery member 630 that can be seen through the outer surface 621 of the body 605 via a window 625 (the applicator 632 can also be considered a visible portion). The reservoir 635 can be conceptually divided into a top portion 646, a middle portion 647 and a bottom portion 648. The delivery member 630 is in fluid communication with the fluid composition along the length of the delivery member 630. Thought of another way, the delivery member 630 is in fluid communication with the fluid composition at the bottom, middle and top portions 646, 647, 648 of the reservoir 635.

In the exemplified embodiment, the oral care fluid 636 floats atop the indicator fluid 637. This layering of the oral care fluid 636 and the indicator fluid 637 can be achieved by the indicator fluid 637 being hydrophobic and the oral care fluid 636 being hydrophilic, or vice versa. In other embodiments, differences in densities between the oral care fluid 636 and the indicator fluid 637 can be utilized to achieve the desired layering. For example, without limitation, the indicator fluid 637 can be triacetin, also known as glycerol triacetate, which has a density of 1.16. Thus, if the oral care fluid 636 is water-based, the oral care fluid 636 will float atop of the indicator fluid 637 by virtue of the indicator fluid 637 having a higher density than the oral care fluid 636. In this example, the indicator fluid 637 will settle at the bottom portion 648 of the reservoir 635 and the oral care fluid 636 will fill the middle portion 647 and the top portion 646 of the reservoir 635. Other methods of ensuring that the oral care fluid 636 will float atop of the indicator fluid 637 and that the indicator fluid 637 will settle at the bottom portion 648 of the reservoir 635 can be used, including any of the methods discussed above with regard to the oral care implement 100.

Specific examples of formulations that may be used to form the oral care fluid 636 and the indicator fluid 637, wherein the oral care fluid 636 floats atop of the indicator fluid 637 can be found in Tables 1 and 2 below:

TABLE 1

| (Top layer (oral care fluid) hydrophobic, bottom layer (indicator fluid) hydrophilic) | |
|---|---|
| | % |
| Top layer ingredients (about 95% of total formula) | |
| Mineral Oil | 89.995 |
| Anti-bacterial agent (e.g. magnolia extract) | 10 |
| Oil-soluble blue color | 0.005 |
| Total | 100% |
| Bottom layer ingredients (about 5% of total formula) | |
| An aqueous solution of a red dye, e.g. 0.005% Allura Red in water | |

TABLE 2

| (Top layer (oral care fluid) hydrophilic, bottom layer (indicator fluid) hydrophobic) | |
|---|---|
| | % |
| Top layer ingredients (about 95% of total formula) | |
| Glycerin | 15.00 |
| Propylene Glycol | 17.00 |
| Ethyl alcohol | 6.25 |
| Trisodium citrate | 0.51 |

TABLE 2-continued

| (Top layer (oral care fluid) hydrophilic, bottom layer (indicator fluid) hydrophobic) | |
|---|---|
| | % |
| Citric Acid | 0.06 |
| Saccharin | 2.50 |
| Flavor | 30.00 |
| CPC | 15.00 |
| Blue Dye | 0.005 |
| Water | 13.675 |
| Total | 100% |
| Bottom layer ingredients (about 5% of total formula) | |
| Triacetin | 89.995 |
| Anti-bacterial agent | 10 |
| Red dye | 0.005 |
| Total | 100% |

In some embodiments, the oral care fluid 636 has a first color and the indicator fluid 637 has a second color, such that the first color is different than the second color. In one embodiment, the first color can be transparent while the second color is a visible color so that it provides a visual indication to a user. Furthermore, it should be understood that the first color is not limited to being transparent/clear and the first color can be any other visible color, so long as the first color and the second color are distinct from each other.

The capillary material of the delivery member 630 will adsorb the fluids 636, 637 and take-on the color of the fluids 636, 637. However, because the delivery member 630 is pre-adsorbed with the oral care fluid 636, which is hydrophilic, and the indicator fluid 637 is hydrophobic, the indicator fluid 637 will be adsorbed by the delivery member 630 only after a substantial amount, if not all, of the oral care fluid 636 has been depleted from the reservoir 635. The pre-adsorption of the oral care fluid 636 into the delivery member 630 can be achieved by pre-soaking the delivery member 630 in the oral care fluid 636 rather than immersing the delivery member 630 into the composition in a dry-state, which could cause the colors of the fluids 636, 637 to mix together.

Because the delivery member 630 is pre-saturated with the oral care fluid 636, the delivery member 630 appears to take on the color of the oral care fluid 636 (or a derivative thereof). As the oral care fluid 636 is delivered to the applicator 632 via capillary action, the color of the oral care fluid 636 can be seen on the visible portion 633 of the delivery member 630 through the window 625. During use of the oral care implement 600 to clean a user's teeth or other oral surfaces, the oral care fluid 636 will be expelled from the applicator portion 632 of the delivery member 630 and delivered to a user's oral cavity. As the oral care fluid 636 is adsorbed by the delivery member 630 and delivered to the user's oral cavity, the oral care fluid 636 within the reservoir 635 continues to be adsorbed by the delivery member 630 until the oral care fluid 636 within the reservoir 635 is depleted. The hydrophobic nature of the indicator fluid 637 prohibits the indicator fluid 637 from being transported by the delivery member 630 until the delivery member 630 is sufficiently empty of the oral care fluid 636, even though the indicator fluid 637 is in fluid communication with the delivery member 630.

Referring to FIGS. 7 and 8 concurrently, upon depletion of the oral care fluid 636 within the reservoir 635, the delivery member 630 begins adsorbing the indicator fluid 637 and transporting the indicator fluid 637 towards the applicator 632 via capillary action. As the indicator fluid 637 is adsorbed by the delivery member 630, the color of the delivery member 630 changes. Specifically, the color of the delivery member 630 will change from being the color of the oral care fluid 636 to either being the color of the indicator fluid 637 or a color that is the combination of the color of the oral care fluid 636 and the color of the indicator fluid 637 as has been described in detail above with reference to FIGS. 1-5. Specifically, if the capillary material of the delivery member 630 has a holding capacity that releases all of the oral care fluid 636 or if the oral care fluid 636 is colorless (clear), then the delivery member 630 will take on the color of the indicator fluid 637 (or a shade thereof). However, if the oral care fluid 636 is not transparent/clear and the capillary material of the delivery member 630 has a holding capacity that does not release all of the oral care fluid 636, the delivery member 630 will take on a color that is a resultant of the combination of colors of the oral care fluid 636 and the indicator fluid 637 due to remnants of the oral care fluid 636 remaining within the delivery member 630.

The user will continue to use the oral care implement 600 until the indicator fluid 637 is delivered to the visible portion 633 of the delivery member 630 such that the color change described above can be seen on the visible portion 633 of the delivery member 630 via the window 625. It is preferable that the window 625 is located on the body 605 near or adjacent to the head 610, such as on a neck portion of the body 605, so that most, if not all, of the oral care fluid 636 has been depleted by the time the user sees the color change of the visible portion 633 of the delivery member 630. Of course, in embodiments that omit the window 625, the user will continue to use the oral care implement 600 until the color change described above can be visually detected on the exposed applicator 632. When the color of the indicator fluid 637 (or a mixture of the color of the indicator fluid 637 and the color of the oral care fluid 636) can be seen on the visible portion 633 of the delivery member 630 (or on the applicator 632), the user will be visually cued that the oral care fluid 636 has been substantially, if not completely, depleted. Thus, the oral care implement 600 delivers the oral care fluid 636 to a user to achieve hygienic benefits and provides a visual indication of depletion of the oral care fluid 636 within the reservoir 635.

Figure 9:
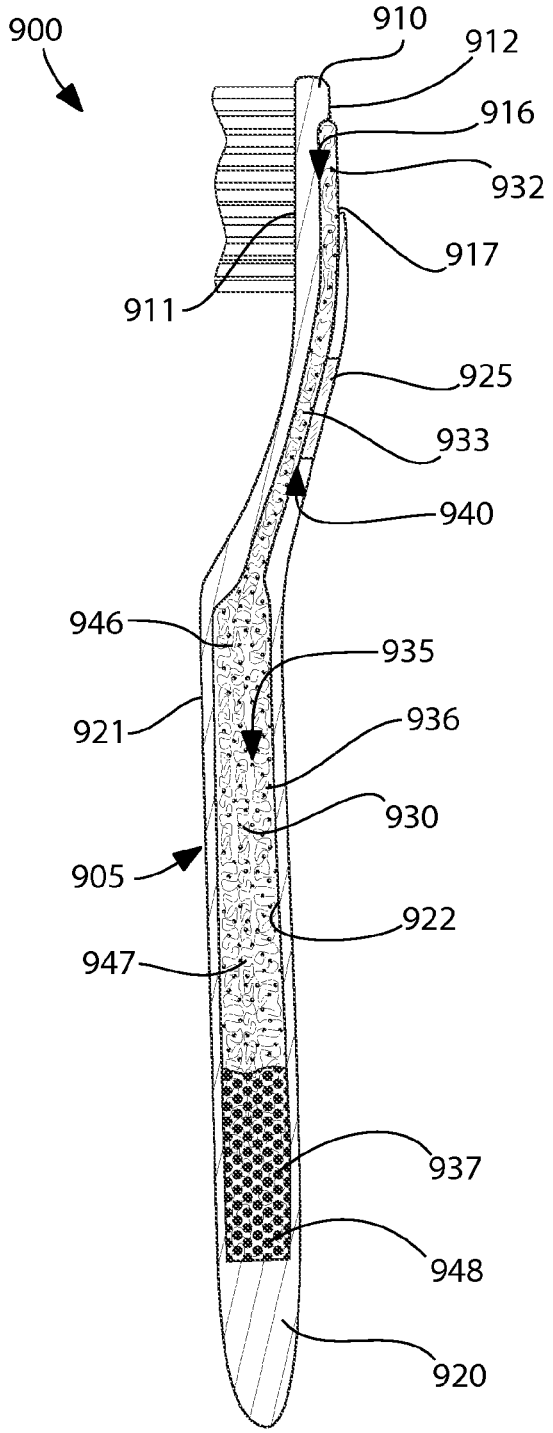
FIG. 9 is a longitudinal cross-sectional view of a toothbrush according to a third embodiment of the present invention, wherein a delivery member fills the entirety of the reservoir and contains the oral care fluid and an indicator fluid pre-adsorbed therein.
Figure 10:
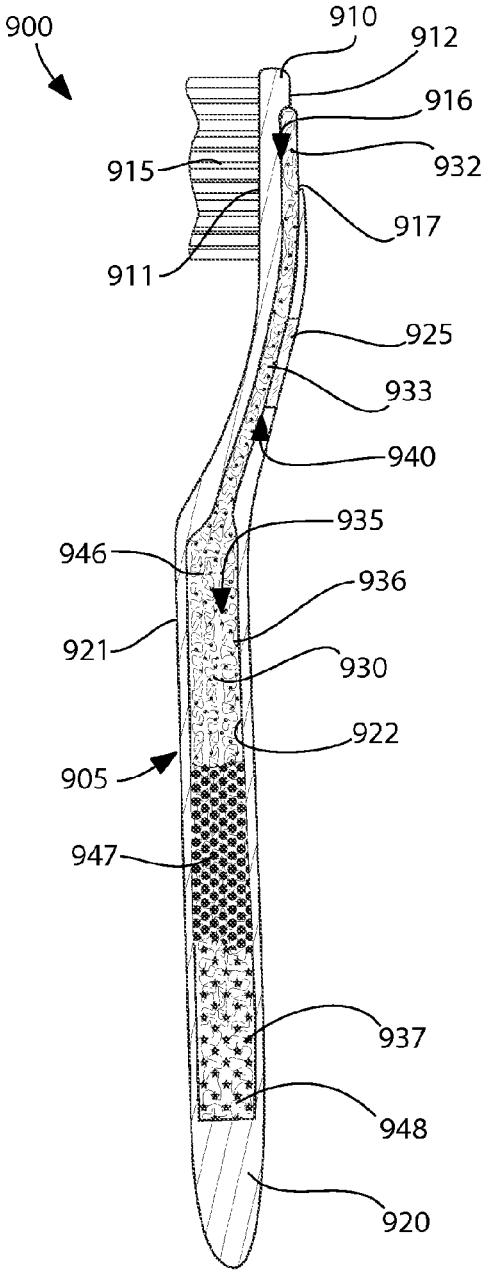
FIG. 10 is a similar view as FIG. 9, wherein the indicator fluid begins to be transported through the delivery member via capillary action.
Figure 11:
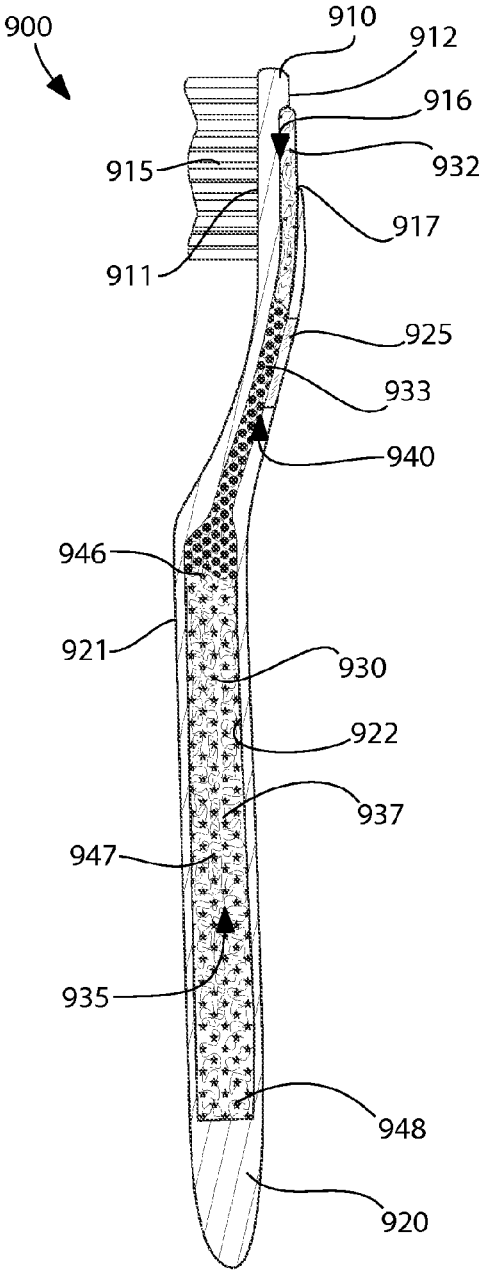
FIG. 11 is a similar view as FIG. 9, wherein the indicator fluid has been transported to a visible portion of the delivery member via capillary action.

Referring now to FIGS. 9-11, another embodiment of an oral care implement 900 in accordance with the present invention will be described. The oral care implement 900 has many features that are similar to or the same as features of the oral care implement 100 and the oral care implement 600. Thus, similar features will be similarly numbered with the exception that the 900-series of numbers will be used. It should be understood that features and components of the oral care implement 900 that are not described in detail herein are the same as corresponding features and components of the oral care implement 100 and/or the oral care implement 600. It will become apparent from the description below that the oral care implement 900 is substantially similar to the oral care implement 600 except that the delivery member fills the entirety of the reservoir.

The oral care implement 900 comprises a body 905 having a handle 920 and a head 910 coupled to an end of the handle 920. The head 910 comprises a front surface 911 from which a plurality of tooth cleaning elements 915 extend and an opposed rear surface 912. Although not illustrated, the rear surface 912 of the head 910 may comprise a soft tissue cleanser, such as was described above with regard to the oral care implement 100. The body 905 comprises an outer surface 921 and an inner surface 922. The inner surface 922 of the body 905 defines an open area or internal reservoir 935 containing a fluid composition therein. In the exemplified embodiment, the reservoir 935 is formed within the handle 920 of the body 905. Of course, the invention is not so limited and the reservoir 935 may be formed in the head 910 or neck of the oral care implement 900 in other embodiments.

The oral care implement 900 comprises a channel 940 that extends from the reservoir 935 to an opening 917. The channel 940 forms a passageway from the reservoir 935 to the opening 917 and the opening 917 forms a passageway from the channel 940 to a depression 916 on the rear surface 912 of the head 910. An applicator 932 nests within the depression 916 and is exposed to the external environment on the rear surface 912 of the head 910.

A delivery member 930 formed of a capillary material, which may be a porous or fibrous material as discussed above, is disposed within the reservoir 935. The delivery member 930 is disposed within the reservoir 935 so as to substantially fill the entirety of the reservoir 935. Furthermore, the delivery member 930 extends from the reservoir 935, through the channel 940 and the opening 917 and into the depression 916. The delivery member 930 is unitarily formed with the applicator 932 as a single structural unit. Thus, the delivery member 930 and the applicator 932 are both formed of the capillary material and are in communication such that as fluid flows up the delivery member 930 by capillary action, the fluid is delivered to the applicator 932 for application to a user's oral surfaces.

The body 905 of the oral care implement 900 comprises a window 925 that enables a user to view a visible portion 933 of the delivery member 930 through the outer surface 921 of the body 905. The visible portion 933 of the delivery member 930 is disposed within the channel 940 between the reservoir 935 and the applicator 932. Thus, as will be described in more detail below, a user can determine whether an oral care fluid 936 is substantially depleted based upon the color of the delivery member 930 at the visible portion 933. In embodiments that omit the window 925, the applicator 932 can be the visible portion of the delivery member 935.

The reservoir 935 can be conceptually divided into a bottom portion 948, a middle portion 947 and a top portion 946. The delivery member 930 is adsorbed with the fluid composition. More specifically, a portion of the delivery member 930 that is located at the bottom portion 948 of the reservoir 935 is adsorbed with an indicator fluid 937 and the remaining portion of the delivery member 930, which includes the portion of the delivery member 930 that is located at the middle and top portions 947, 946 of the reservoir 935, is adsorbed with an oral care fluid 936. The oral care fluid 936 can be any of the oral care fluids discussed above that impart a hygienic benefit to a user upon application to the user's oral cavity.

During use of the oral care implement 900, pressure will be applied to the applicator 932 which will cause the oral care fluid 936 to be dispensed from the applicator 932 to the user's oral cavity. As the oral care fluid 936 slowly depletes, the indicator fluid 937 will flow up the delivery member 937 via capillary action and seep into the regions of the delivery member 937 that were previously filled with the oral care fluid 936.

As has been discussed in detail above with reference to FIGS. 1-8, the oral care fluid 936 is a first color and the indicator fluid 937 is a second color. The portion of the delivery member 930 that is located at the bottom portion 948 of the reservoir 935 is adsorbed with the indicator fluid 937 and appears the second color. The remainder of the delivery member 930 is adsorbed with the oral care fluid 936 and appears the first color. Thus, prior to use of the oral care implement 900, the visible portion 933 of the delivery member 930 will be adsorbed with the oral care fluid 936 and will take on the first color. As the oral care fluid 936 depletes as discussed above, the indicator fluid 937 begins to flow to the visible portion 933 of the delivery member 930. Depending on what the actual first and second colors are, portions of the delivery member 930 may either appear as the second color when adsorbed with the indicator fluid 937 or may appear as a third different color that is a resultant color of the combination of the first and second colors. Either way, when the visible portion 933 (or the applicator 932) of the delivery member 930 takes on the second color (or the third resultant color) due to the indicator fluid 937 being transported thereto, the user will have received a visual cue that the oral care fluid 936 has been substantially depleted from the reservoir 935.

Figure 12:
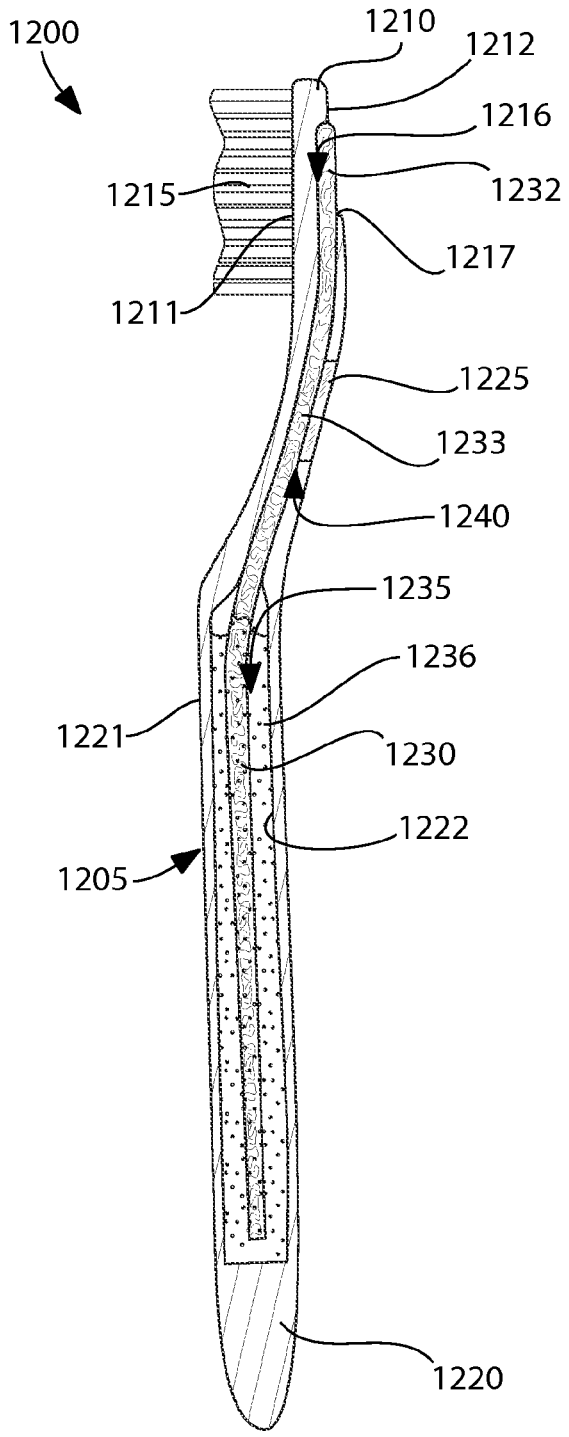
FIG. 12 is a longitudinal cross-sectional view of a toothbrush according to a fourth embodiment of the present invention, wherein a delivery member is formed of a first color and a reservoir contains an oral care fluid formed of a second color.
Figure 13:
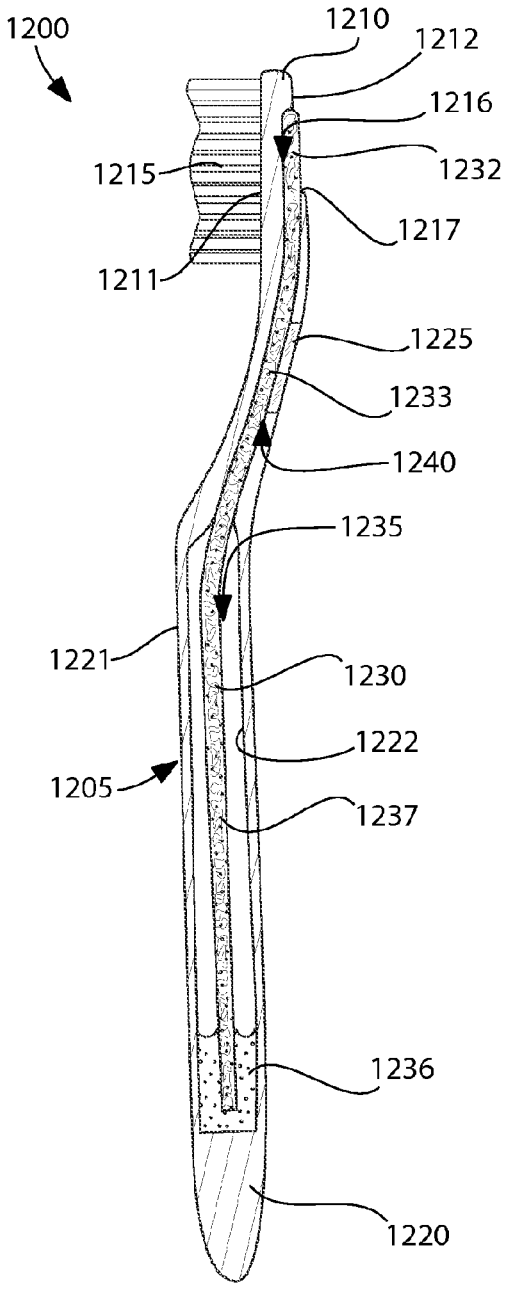
FIG. 13 is a similar view as FIG. 12, wherein the delivery member has adsorbed the oral care material and taken on the color of the oral care material.
Figure 14:
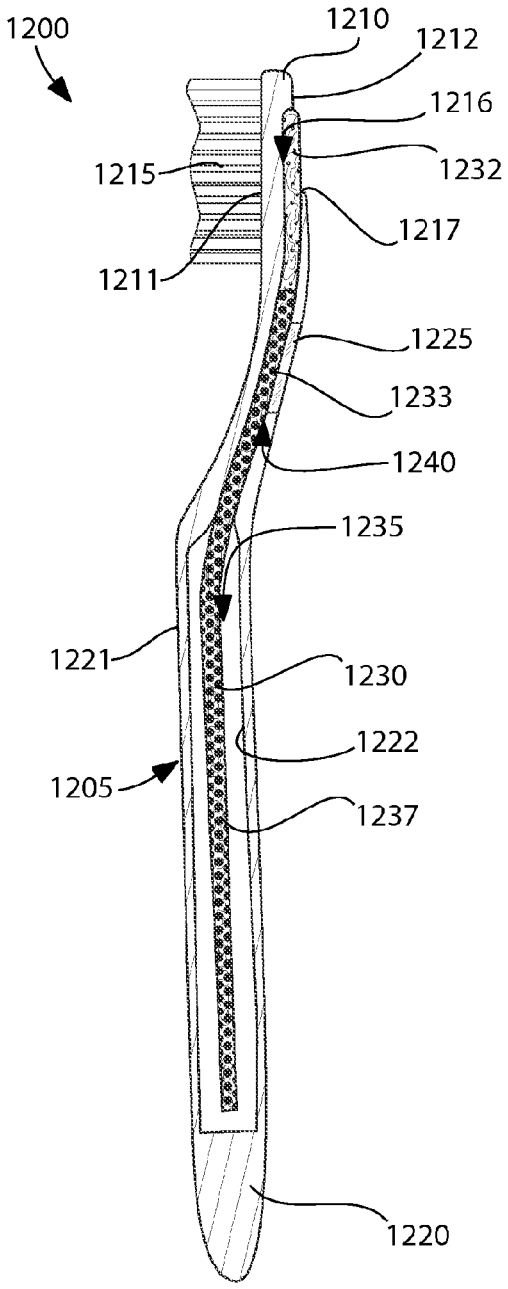
FIG. 14 is a similar view as FIG. 12, wherein the visible portion of the oral care material has been depleted form the reservoir and the visible portion of the delivery member has become a third color.

Referring now to FIGS. 12-14, another embodiment of an oral care implement 1200 in accordance with the present invention will be described. The oral care implement 1200 has many features that are similar to or the same as features of the oral care implements 100, 600, 900. Thus, similar features will be similarly numbered with the exception that the 1200-series of numbers will be used. It should be understood that features and components of the oral care implement 1200 that are not described in detail herein are the same as corresponding features and components of the oral care implement 100 and/or the oral care implement 600 and/or the oral care implement 900.

The oral care implement 1200 comprises a body 1205 having a handle 1220 and a head 1210 coupled to an end of the handle 1220. The head 1210 comprises a front surface 1211 from which a plurality of tooth cleaning elements 1215 extend and an opposed rear surface 1212. Although not illustrated, the rear surface 1212 of the head 1210 may comprise a soft tissue cleanser, such as was described above with regard to the oral care implement 100. The body 1205 comprises an outer surface 1221 and an inner surface 1222. The inner surface 1222 of the body 1205 defines an open area or internal reservoir 1235 containing a fluid composition therein. In the exemplified embodiment, the reservoir 1235 is formed within the handle 1220 of the body 1205. Of course, the invention is not so limited and the reservoir 1235 may be formed in the head 1210 or neck of the oral care implement 1200 in other embodiments.

The oral care implement 1200 comprises a channel 1240 that extends from the reservoir 1235 to an opening 1217. The channel 1240 forms a passageway from the reservoir 1235 to the opening 1217 and the opening 1217 forms a passageway from the channel 1240 to a depression 1216 on the rear surface 1212 of the head 1210. An applicator 1232 nests within the depression 1216 and is exposed to the external environment on the rear surface 1212 of the head 1210.

A delivery member 1230 formed of a capillary material, which may be any of the capillary materials discussed above, is disposed within the reservoir 1235. The delivery member 1230 is disposed within the reservoir 1235 so as to substantially fill the entirety of the reservoir 1235. Furthermore, the delivery member 1230 extends from the reservoir 1235, through the channel 1240 and the opening 1217 and into the depression 1216. The delivery member 1230 is unitarily formed with the applicator 1232 as a single structural unit. Thus, the delivery member 1230 and the applicator 1232 are both formed of the capillary material and are in communication such that as fluid flows up the delivery member 1230 by capillary action, the fluid is delivered to the applicator 1232 for application to a user's oral surfaces.

The body 1205 of the oral care implement 1200 comprises a window 1225 that enables a user to view a visible portion 1233 of the delivery member 1230 through the outer surface 1221 of the body 1205. The visible portion 1233 of the delivery member 1230 is disposed within the channel 1240 between the reservoir 1235 and the applicator 1232. Thus, as will be described in more detail below, a user can determine whether an oral care fluid 1236 disposed within the reservoir 1235 is substantially depleted based upon the color of the delivery member 1230 at the visible portion 1233. In embodiments that omit the window 1225, the applicator 1232 can be the visible portion of the delivery member 1235.

The oral care fluid 1236 is contained within the reservoir 1235. The oral care fluid 1236 is a fluid that has a first color. The oral care fluid 1236 can be any of one or a combination of the oral care fluids discussed above with reference to FIGS. 1-5. As discussed above, the delivery member 1230 is formed of a capillary material and is disposed within the reservoir 1235. Thus, the oral care fluid 1236 is able to flow up the delivery member 1230 from the reservoir 1235 to the applicator 1232 for application to a user's oral cavity. The delivery member 1233 (including the visible portion 1233) is formed of a capillary material that has a second color that is different than the first color. For ease of example, the first color will be described as being blue and the second color will be described as being yellow. However, the invention is not to be so limited and in other embodiments the first and second colors can be any other color and/or switched.

As can be seen in FIG. 12, as the oral care fluid 1236 becomes adsorbed into the capillary material of the delivery member 1230 in sufficient quantity (for example saturation), the delivery member 1230 takes on the color (i.e., blue) of the oral care fluid 1236. As such, the delivery member 1230 appears blue to a user. This is due to the large concentration of the oral care fluid 1236 being adsorbed into the delivery member 1230 and over-taking the natural color of the capillary material of the delivery member 1230.

Referring to FIG. 13, as the oral care material 1236 continues to flow up the delivery member 1230 during use of the oral care implement 1200 as has been described in detail above, the entirety of the delivery member 1230 tales on the first color (i.e., blue) of the oral care fluid 1236 due to the high concentration of the oral care fluid 1236 within the delivery member 1230.

Referring now to FIG. 14, as the oral care fluid 1236 flows further up the capillary material of the delivery member 1230 and the oral care fluid 1236 becomes depleted from the reservoir 1235, the concentration of the oral care fluid 1236 within the delivery member 1230 decreases. As a result, the delivery member 1230 begins to turn a third color 1237, the third color 1237 being different than both of the first and second colors. In one embodiment, the third color 1237 is a resultant color of the combination of the first and second colors. In the example, as the oral care fluid 1236 flows up towards the applicator 1232, a residual amount of the blue coloring of the oral care fluid 1236 will remain within the delivery member 1230 after depletion. As a result, the natural color (i.e., yellow) of the capillary material of the delivery member 1230 begins to combine with the residual color (i.e., blue) of the oral care fluid 1236 so that the delivery member 1230 appears to take on the third color 1237 (i.e., green). In certain embodiments, the first and second colors are primary colors and the third color 1237 is a secondary color.

Thus, over time the visible portion 1233 of the delivery member 1230 turns to the third color 1237. When the user views the visible portion 1233 of the delivery member 1230 through the window 1225 and sees the third color 1237, the user thereby receives a visual cue that the oral care fluid 1236 is substantially depleted and that the oral care implement 1200 should be replaced.

While the foregoing description discusses the oral care fluid 136, 636, 936, 1236 as a single oral care fluid, in certain embodiments, the oral care fluid 136, 636, 936, 1236 can include more than one oral care fluid. For example, the oral care fluid 136, 636, 936, 1236 can be a mixture of two or more oral care fluid. For another example, the oral care fluid 136, 636, 936, 1236 can include two immiscible oral care fluids. In this example, the user of the oral care implement 100, 600, 900, 1200 may use one of the oral care fluids during a first time period and use the other one of the oral care fluids during a second time period after the first time period has elapsed.

As used throughout, ranges are used as shorthand for describing each and every value that is within the range. Any value within the range can be selected as the terminus of the range. Furthermore, it should be understood that the different components and elements described in the different embodiments herein can be combined to create a desired effect. In addition, all references cited herein are hereby incorporated by referenced in their entireties. In the event of a conflict in a definition in the present disclosure and that of a cited reference, the present disclosure controls.

What is claimed is:

1. An oral care implement comprising:

a body comprising a reservoir containing a composition including an oral care fluid and an indicator fluid, the oral care fluid being a different color than the indicator fluid and immiscible with respect to the indicator fluid;

a delivery member formed of a capillary material;

the oral care fluid and the indicator fluid arranged within the reservoir so that when the oral care fluid within the reservoir is substantially depleted, the indicator fluid is delivered to a visible portion of the delivery member by capillary action; and wherein the delivery member is in fluid communication with the composition only at a bottom portion of the reservoir, the oral care fluid having a density that is greater than a density of the indicator fluid.

2. The oral care implement according to claim 1 wherein the visible portion of the delivery member is aligned with a window in the body.

3. The oral care implement according to claim 1 wherein the visible portion of the delivery member is an applicator.

4. The oral care implement according to claim 1 wherein one of the oral care fluid or the indicator fluid is hydrophobic and the other one of the oral care fluid or the indicator fluid is hydrophilic.

5. The oral care implement according to claim 1 wherein the delivery member extends through a top portion and a middle portion of the reservoir within a fluid-impermeable sheath, the sheath comprising an opening within the bottom portion of the reservoir that provides fluid communication between the delivery member and the composition, and wherein the indicator fluid does not come into contact with the delivery member until a fluid-to-fluid interface between the oral care fluid and the indicator fluid is beneath the opening of the sheath.

6. The oral care implement according to claim 1 wherein the delivery member transports the oral care fluid and the indicator fluid solely by capillary action of the capillary material.

7. The oral care implement according to claim 1 wherein the visible portion of the delivery member changes color upon delivery of the indicator fluid to the visible portion.

8. The oral care implement according to claim 1 wherein the bottom of the reservoir is located at a proximal end of the body and the visible portion of the delivery member is located at a distal end of the body.

9. The oral care implement according to claim 1 wherein the indicator fluid floats atop the oral care fluid to form a fluid-to-fluid interface, and wherein the fluid-to-fluid interface moves toward the bottom portion of the reservoir as the oral care fluid is used.

10. The oral care implement according to claim 1 wherein the delivery member extends through a top portion and a middle portion of the reservoir within a fluid-impermeable sheath.

11. The oral care implement according to claim 1 wherein the body comprises a handle and a head.

12. The oral care implement according to claim 1 wherein the capillary material of the delivery member is selected from a group consisting of a porous material and a fibrous material.

13. The oral care implement according to claim 1 wherein the visible portion of the delivery member appears a first color when adsorbed with the oral care fluid and a second color when adsorbed with the indicator fluid, the first color being different than the second color.

14. An oral care implement comprising:

a body comprising a reservoir containing a composition including an oral care fluid, the oral care fluid being a first color;

a delivery member formed of a capillary material having a second color; and a visible portion of the delivery member appearing the first color when fully adsorbed with the oral care fluid and a third color upon depletion of the oral care fluid within the reservoir, wherein the first, second and third colors are different from one another.

15. The oral care implement according to claim 14 wherein the third color is a resultant color of the combination of the first and second colors.

16. The oral care implement according to claim 14 wherein the visible portion of the delivery member is aligned with a window in the body.

17. The oral care implement according to claim 14 wherein the visible portion of the delivery member is an applicator.

18. The oral care implement according to claim 14 wherein the delivery member transports the oral care fluid solely by capillary action of the capillary material.

19. The oral care implement according to claim 14 wherein the visible portion of the delivery member changes from the second color to the first color upon delivery of the oral care fluid to the visible portion.

20. The oral care implement according to claim 14 wherein the capillary material of the delivery member is selected from a group consisting of a porous material and a fibrous material.

21. A dispenser comprising:

a reservoir containing a composition including a first fluid and a second fluid, the first fluid being a different color than the second fluid and immiscible with respect to the first fluid;

a delivery member formed of a capillary material; and the first and second fluids arranged within the reservoir so that upon the first fluid within the reservoir being substantially depleted, the second fluid is delivered to a visible portion of the delivery member by capillary action;

wherein the delivery member is in fluid communication with the composition only at a bottom portion of the reservoir, the oral care fluid having a density that is greater than a density of the indicator fluid.

22. The dispenser according to claim 21 wherein the visible portion of the delivery member appears a first color when adsorbed with the first fluid and a second color when adsorbed with the second fluid, the first color being different than the second color.

23. The dispenser according to claim 21 wherein one of the first or second fluids is hydrophobic and the other one of the first and second fluids is hydrophilic.

24. The oral care implement according to claim 21 wherein the delivery member transports the first and second fluids solely by capillary action of the capillary material.

25. A dispenser comprising:

a reservoir containing a composition including a first fluid, the first fluid being a first color;

a delivery member formed of a capillary material having to second color; and a visible portion of the delivery member appearing the first color when fully adsorbed with the first fluid and a third color upon depletion of the first fluid within the reservoir, wherein the first, second and third colors are different from one another.

26. The dispenser according to claim 25 wherein the third color is a resultant color of the combination of the first and second colors.

27. The dispenser according to claim 25 wherein the third color is a secondary color and the first and second colors are primary colors.

* * * * *